United States Patent [19]

Corliss

[11] Patent Number: 4,845,864

[45] Date of Patent: Jul. 11, 1989

[54] CYCLIST'S SHOE AND THE LIKE WITH SEPARATELY ADJUSTABLE DIAGONAL AND TRANSVERSE STRAPS FOR INDEPENDENT INSTEP AND FOREFOOT FIT CONTROL

[75] Inventor: William Corliss, Evanston, Ill.

[73] Assignee: Schwinn Bicycle Company, Chicago, Ill.

[21] Appl. No.: 156,311

[22] Filed: Feb. 16, 1988

[51] Int. Cl.[4] ..... A43B 5/14; A43C 11/00

[52] U.S. Cl. ..... 36/131; 36/50

[58] Field of Search ..... 36/50, 51, 54, 131

[56] References Cited

U.S. PATENT DOCUMENTS

| | | | |
|---|---|---|---|
| 4,065,861 | 1/1978 | Pelprey | 36/50 X |
| 4,079,527 | 3/1978 | Antonious . | |
| 4,114,297 | 9/1978 | Famolare, Jr. . | |
| 4,308,672 | 1/1982 | Antonious . | |
| 4,361,972 | 12/1982 | Miller . | |
| 4,377,913 | 3/1983 | Stone . | |
| 4,451,995 | 6/1984 | Antonious | 36/51 |
| 4,476,639 | 10/1984 | Zaccaria . | |
| 4,550,511 | 11/1985 | Gamm . | |
| 4,566,207 | 1/1986 | Struntz . | |
| 4,628,622 | 12/1986 | McBarron . | |
| 4,642,914 | 2/1987 | Caldeira . | |

FOREIGN PATENT DOCUMENTS

| | | | |
|---|---|---|---|
| 579941 | 8/1924 | France | 36/50 |
| 2499375 | 8/1982 | France . | |
| 2516762 | 5/1983 | France | 36/51 |
| 2555417 | 5/1985 | France | 36/131 |
| 237109 | 7/1986 | German Democratic Rep. | 36/131 |
| 19641 | of 1901 | United Kingdom | 36/50 |
| 2048646 | 12/1980 | United Kingdom . | |

OTHER PUBLICATIONS

"Bicycling" Newsletter, vol. 5, No. 8, Aug., 1986, pp. 30–42; Buyers' Guide to Cleated Cycling Shoes Article.
"Bicycle Guide", pp. 133–141; 1986 Buyers' Annual Article.
"Bicycling", Apr. 1987, p. 49; Avocet Advertisement.
"Bicycling", Apr., 1987, p. 69; Look Advertisement.
"Bicycling", Apr., 1987, p. 126.
"Bicycling", Jun., 1987, p. 69; Vittoria Advertisement.
"Bicycling", Jul., 1987, Duegi Advertisement.
"Bicycling", Jul., 1987, p. 20; Asics Tiger Advertisement.
"Bicycling", Jul. 1987; Specialized Advertisement.
"Bicycling", Jul., 1987, p. 105; Diadora Advertisement.
"Bicycling", Aug., 1987, p. 31; Specialized Advertisement.

*Primary Examiner*—James Kee Chi
*Attorney, Agent, or Firm*—McCaleb, Lucas & Brugman

[57] ABSTRACT

A cyclist shoe comprises a sole and an upper. The upper has a vamp with a variable throat located between side panels. Separately adjustable inner and outer straps have releasable hook and pile connections. Opposite end portions of each strap are secured to the side panels. The inner strap extends across the throat and along one side panel in a diagonal direction for primarily fitting the shoe to a cyclist's instep. The outer strap comprises a relatively large, flexible panel covering a substantial portion of the vamp around the throat. It extends across the vamp and the side panels in a transverse direction for primarily fitting the shoe to the cyclist's forefoot. A free end of the inner strap is exposed through a window in the outer strap enabling adjustment of the inner strap independently of the outer strap.

4 Claims, 2 Drawing Sheets

CYCLIST'S SHOE AND THE LIKE WITH SEPARATELY ADJUSTABLE DIAGONAL AND TRANSVERSE STRAPS FOR INDEPENDENT INSTEP AND FOREFOOT FIT CONTROL

BACKGROUND OF THE INVENTION

There are two distinct types of cycling shoes: cleated "racing" shoes and non-cleated "touring" shoes. Both help the feet work more efficiently than non-cycling shoes.

Cleated shoes are not just for racers. They help anyone improve cycling efficiency by maximizing power transmission from foot to pedal. They have a cleat on the bottom of the toe sole with a slot which engages the pedal cage. This holds the foot in the ideal fore/aft position with the ball of the foot directly over the pedal axle. The slot is deep enough to maintain a secure hold between the shoe and pedal even during the upstroke. To dismount at the end of a ride, or for an emergency preceding a fall, the cleats can be disconnected quickly from the pedal cages by turning and lifting the feet.

Super-stiff wood sole shoes with cleats are available for professionals desiring that last extra bit of efficiency.

While such cleated connections maximize the efficiency of energy transfer from the shoe to the pedal, there has been considerable room for improvement in the efficiency of energy transfer from the foot itself to the shoe, and in the comfort and fit of the foot within the shoe.

At one time most cycling shoes used laces or buckles. Many still use laces. After a while, with constant flexing of the soft upper, laces loosen and allow the rider's foot to slip within the shoe. This is inefficient and uncomfortable, requiring the rider to stop and re-tie the laces from time to time.

Buckles requiring straps with eyelets have had only limited usefulness because fine fit adjustments could not be made between the fixed spacings of the eyelets. Such buckles are no longer in use.

Substantial improvements in racing shoes have resulted from the adoption of hook and pile, or hook and loop connections which are marketed under the tradename "VELCRO". With these, infinite, vernier-accurate adjustments are possible. They do not loosen in use as laces do. And, they can be re-adjusted if necessary with one hand without stopping.

Typically, some of these use a "Velcro"-type tongue, or strap with laces as shown in U.S. Pat. Nos. 4,114,297 and 4,361,972; or one or two "Velcro" straps without laces as shown in U.S. Pat. Nos. 4,308,672 and 4,642,914.

An important factor in providing a perfect, slip-free fit for the foot within a cycling shoe at the crucial area directly over the pedal axle, and making the shoe completely comfortable for long-time use, has heretofore been overlooked by manufacturers of cycling shoes having such "Velcro"-type closures. That is the use of separately adjustable inner and outer straps, one primarily for adjusting the fit at the instep, and the other for separately and independently adjusting the fit at the forefoot.

SUMMARY OF THE INVENTION

Accordingly, it is a general object of this invention to provide a cyclist shoe having a pair of separately and independently adjustable straps with hook and pile connections, one primarily to adjust the fit at the instep, and the other primarily to adjust the fit at the forefoot.

Another object is to provide a cyclist shoe with an upper having a vamp with a variable throat located between side panels, an inner strap secured at opposite ends in the side panels and extending in a diagonal direction across the throat and effective when tightened to apply a squeezing force to the vamp in that diagonal direction for primarily fitting the shoe to a cyclist's instep, and a separate, adjustable outer strap overlying the inner strap and comprising a relatively large flexible panel covering a substantial portion of the vamp around the throat and extending in a transverse direction between the side panels effective when tightened to apply a supplemental squeezing force to the vamp in that transverse direction for primarily fitting the shoe to the cyclist's forefoot.

Another object is to provide an elastic closure member in the throat to resist opening thereof.

Another object is to provide such a cyclist shoe in which the inner strap comprises a fastener strap and an anchor strap, the fastener strap being an elongated hook and pile retention member extending in a diagonal direction relative to the throat and the anchor strap being a flexible member overlying the throat and having a loop at the free end engageable with the free end of the fastener strap; and the outer strap overlies the inner strap and comprises a relatively large flexible panel with hook and pile retention means acting between its free end and an attachment area on one of the side panels.

Another object is to provide a window in the free end of the outer strap through which the fastener strap may readily be grasped to re-adjust the tension of the inner strap independently of the outer strap.

Another object is to hingedly secure the anchor strap and the outer strap to the same side panel.

BRIEF DESCRIPTION OF THE DRAWINGS

Other objects and advantages will be apparent from the following description taken in connection with the drawings in which.

Like parts are referred to by like reference characters throughout the figures of the drawings.

DESCRIPTION OF THE PREFERRED EMBODIMENT

Figure 1:
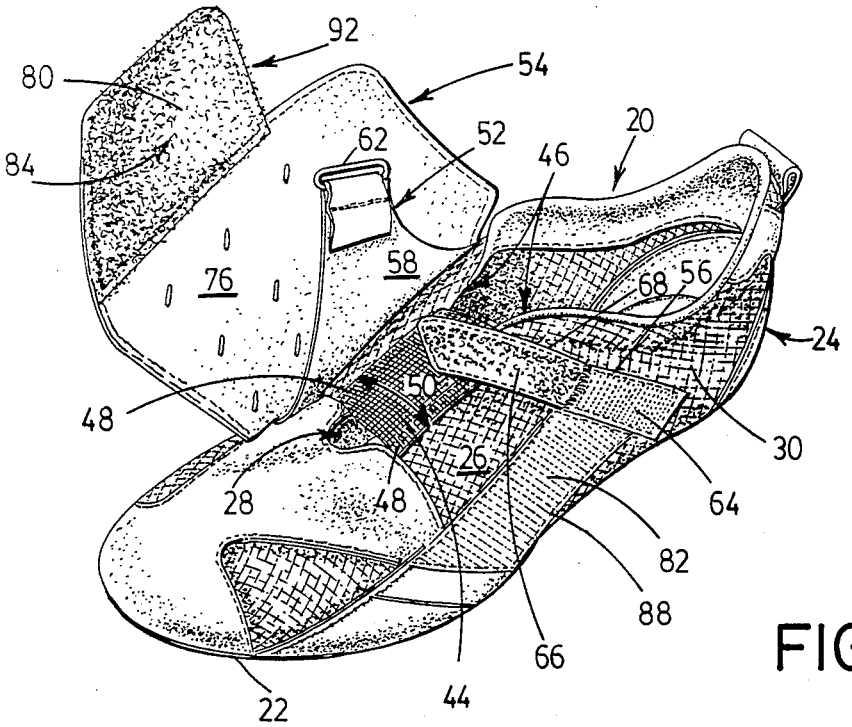
FIG. 1 is a perspective view of a cyclist's shoe illustrating a preferred form of the present invention with inner and outer cinch-type closure straps in open positions.

Referring now to the specific embodiment of the invention shown in the drawings, the cyclist's shoe is generally designated 20. It comprises a sole 22 of firm leather or plastics material, and an upper 24 of relatively flexible leather and nylon mesh. The upper has a vamp 26 with a variable throat 28 located between outside and inside side panels 30 and 32 respectively.

The undersurface of the sole 22 has plastics heel and toe plates 34 and 36 respectively, and an intermediate cleat 38 held in place by adjustment bolt 40. The cleat has a conventional downward slot 42 engageable with a complementary cage (not shown) on a bicycle pedal. As the description proceeds, it will be evident that while the invention is shown applied to a cleated bicycle racing shoe, it may be applied to sports shoes generally.

The variable throat 28 of the vamp is defined by side edges 46,46. An elastic closure member or tongue 44 is secured in the throat by stitching 48 along edges 46,46. It is elastic in a transverse direction (that is, in the direction of arrow 50 in FIG. 1) to resist opening of the throat.

An important part of the invention comprises two separately adjustable flexible leather strap means, namely, an inner strap means 52 and an outer strap means 54.

Figure 5:
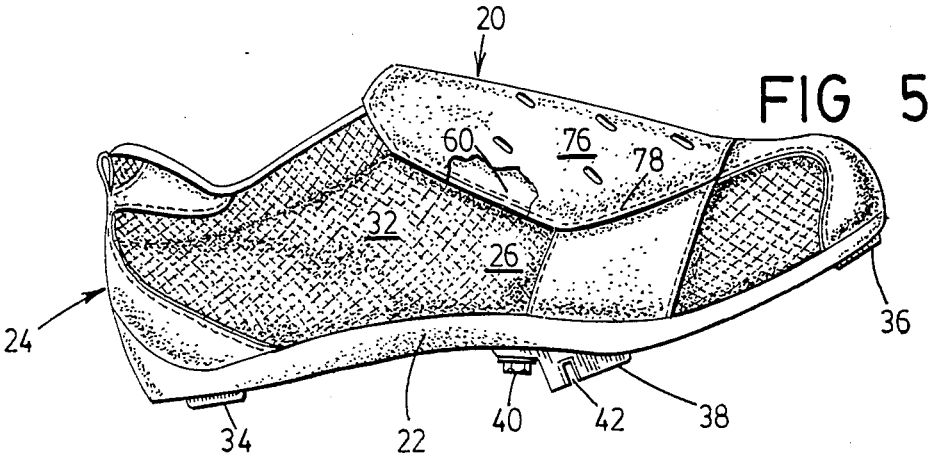
FIG. 5 is a right side elevational view of FIGS. 3 and 4, with the outer strap partially cut away to show the hinged connection of the inner strap to the inside side panel.

The inner strap means 52 comprises a fastener strap 56 and an anchor strap 58. The anchor strap 58 is hingedly secured to the top of the vamp 26 along the inside side panel 32, by one or more lines of stitches 60 (FIG. 5). The opposite, free end of the anchor strap 58 has a loop or flattened ring 62. The fastener strap 56 has a hook or pile surface 64 on a fixed end section secured to the outside side panel 30 and a complementary hook or pile surface 66 on a free end section 68 which passes through the loop or ring 62 when fastened, and extends backwardly to lock the complementary hook and pile surfaces 64,66.

Figure 2:
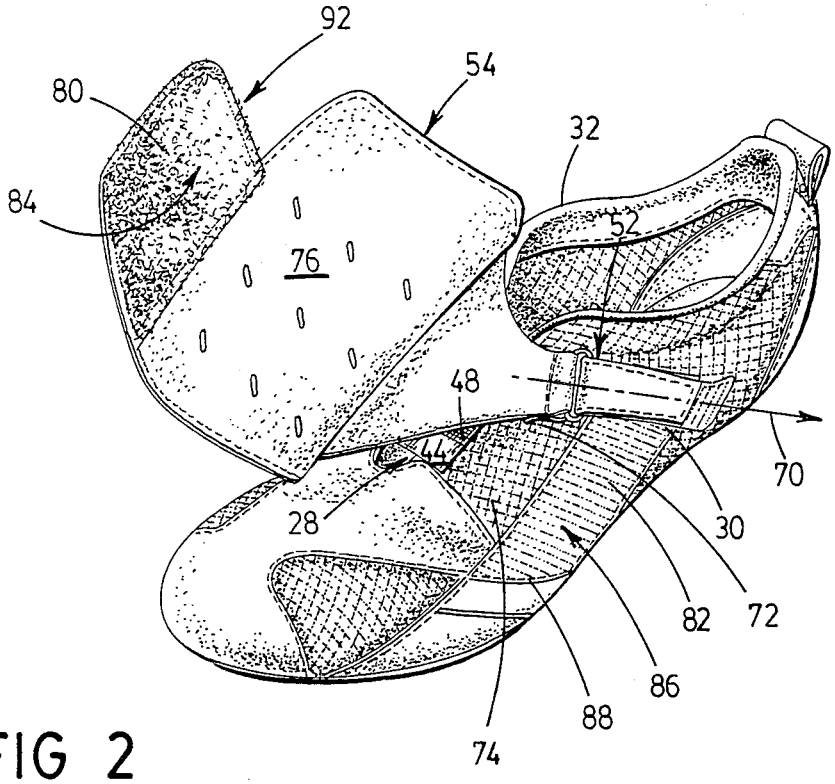
FIG. 2 is a partially closed view similar to FIG. 1 showing the inner closure strap closed.
Figure 3:
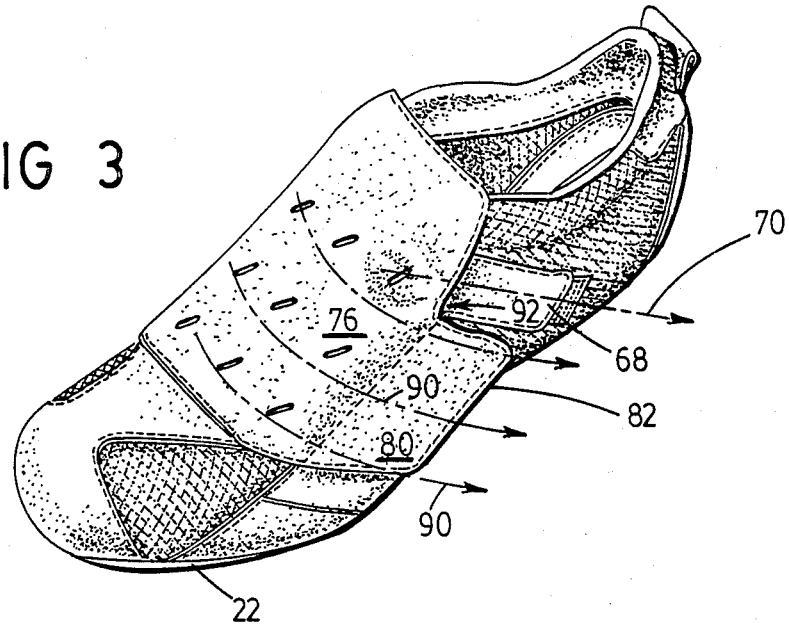
FIG. 3 is a fully closed view similar to FIGS. 1 and 2 showing both the inner and outer closure straps closed.
Figure 4:
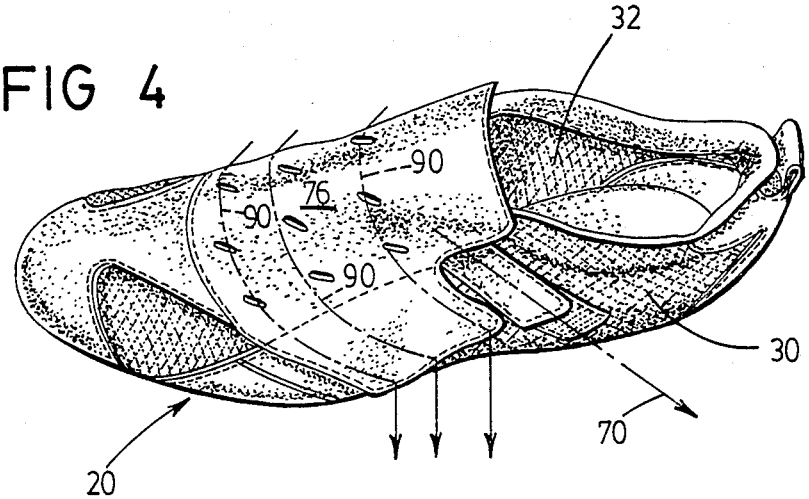
FIG. 4 is a top plan view of FIG. 3.

An important feature of the inner strap means 52 is that the anchor strap 58 and fastener strap 56 extend in a diagonal direction as shown by arrow 70 in FIGS. 2, 3, and 4. This selectively, primarily applies a tightening or closing force to the throat 28 and tightens the instep portion 72 of the shoe onto the user's foot, and secondarily, pre-tightens the forefoot portion 74.

The outer strap means 54 overlies the inner strap means 52 and comprises a relatively large, flexible panel 76 covering a substantial portion of the vamp surrounding the throat 28. It is hingedly secured at one end to the inside side panel 32 by one or more lines of stitches 78 (FIG. 5). It has a free end portion 80 contiguous with a cinch anchor area 82 on the outside side panel 30. The free end portion 80 has a hook or pile surface 84 engageable with a complementary hook or pile surface 86 on the cinch anchor member 82 which is secured as by stitching 88 to the outside side panel 30.

An important feature of the outer strap means is that the large, flexible panel 76 extends and is tensioned in a direction transverse to the longitudinal axis of the shoe, that is, in the direction of transverse arrows 90 in FIGS. 3 and 4. This selectively, primarily tightens the forefoot portion 74 of the shoe onto the user's foot, completing the pre-tightening initially applied by the inner strap means 52.

The large, flexible outer panel 76 has a window 92 at the rear, outer corner of its free end portion 80. This exposes the free end section 68 of the inner strap means fastener strap 56 as best shown in FIGS. 3 and 4, enabling it to be grasped to re-adjust the tension of the inner strap means completely independently of the outer strap means and without disturbing the adjustment of the latter.

Use and operation should be apparent in view of the above description. Briefly, the shoe 20 will be opened wide as shown in FIG. 1, with the inner and outer strap means disconnected to facilitate insertion of the cyclist's foot. Next, the free end section 68 of the fastener strap 56 will be passed through the loop 62 and folded back on itself along diagonal line 70 to a tightness and fit which is comfortable to the user. It will be locked at that position by pressing the complementary hook and pile surfaces 64 and 66 together. Finally, the large, outer strap panel 76 will be pulled taut in the direction of transverse arrows 90 until the desired tightness for optimum fit at the forefoot is attained. The large, flexible panel 76 is of such relatively substantial size that the tension in the forefoot region can be selectively varied by twisting or sluing it while it is pulled, to obtain the ideal fit. It will then be locked at that position by pressing the complementary hook and pile surfaces 84 and 86 together.

One advantage of overlying the inner strap means 52 and the throat 28 with the large, smooth, outer panel 76, as best shown in FIGS. 3, 4, and 5, is an aesthetically pleasingly, smooth, aerodynamic contour, providing less wind resistance and fatigue to the cyclist, especially on long tours approaching one-hundred miles or more per day.

Although the preferred embodiment of the invention is described in detail above, it should be understood that various changes, substitutions, and alterations may be made therein without departing from the spirit and scope of the invention as defined by the appended claims.

The embodiments of the invention in which an exclusive property or privilege is claimed are defined as follows:

1. A cyclist shoe comprising a sole, an upper having a vamp with a variable throat located between outside and inside side panels;

adjustable inner strap means secured at opposite ends respectively to the side panels and extending in a diagonal direction across the throat in the instep portion of the shoe and effective when tightened to apply a sqeezing force to the vamp along said diagonal direction for primarily fitting the shoe to a cyclist's instep; and separate adjustable outer strap means overlying and independent of the inner strap means and comprising a relatively large, flexible panel covering a substantial portion of the vamp around the throat, said outer strap means being secured at opposite ends respectively to the side panels and extending in a transverse direction across the vamp substantially at right angles to a longitudinal axis of the shoe and having a forward part at the forefoot portion of the shoe substantially ahead of the instep portion of the shoe and effective when tightened to apply a supplemental squeezing force to the vamp in said transverse direction at the forefoot portion of the shoe for primarily fitting the shoe to the cyclist's forefoot;

whereby the inner strap means is effective to tighten the instep portion of the shoe independently of the outer strap means; and whereby further the outer strap means is effective to tighten the forefoot portion of the shoe independently of the inner strap means.

2. A cyclist shoe comprising a sole, an upper having a vamp with a variable throat located between outside and inside side panels;

separately adjustable inner and outer strap means;

said inner strap means extending in a diagonal direction, overlying the throat in the instep portion of the shoe, and comprising a fastener strap and an anchor strap;

said fastener strap comprising an elongated hook and pile retention member extending in said diagonal direction relative to the throat and being secured to one of the side panels with a free end extending toward the other side panel;

said anchor strap comprising a flexible member overlying the throat and secured to the other side panel and having a free end extending in said diagonal direction toward the fastener strap and having a loop at the free end engagable with the free end of the fastener strap;

said outer strap means overlying and independent of the inner strap means and comprising a relatively large, flexible panel covering a substantial portion of the vamp in the forefoot portion surrounding the throat, said outer strap means being secured at one end to one of the side panels and having a free end portion contiguous with an attachment area on the other side panel, and hook and pile retention means on said free end portion and on said attachment area;

said outer strap means extending in a transverse direction substantially at right angles to a longitudinal axis of the shoe and having a forward part at the forefoot portion of the shoe substantially ahead of the instep portion;

whereby the inner strap means is effective to tighten the instep portion of the shoe and to pre-tighten the forefoot portion independently of the outer strap means; and whereby further the outer strap means is effective to tighten the forefoot portion of the shoe independently of the inner strap means.

3. A cyclist shoe according to claim 2 in which said free end portion of the outer strap means has a window exposing said free end of the fastener strap whereby the fastener strap may readily be grasped to re-adjust the tension of the inner strap means independently of the outer strap means.

4. A cyclist shoe according to claim 2 in which the anchor strap and the outer strap means are hingedly secured to the same side panel.

* * * * *